United States Patent [19]

McKee et al.

[11] Patent Number: 4,644,121

[45] Date of Patent: Feb. 17, 1987

[54] CIRCUIT BREAKER CONTACT ARM WITH VARIABLE FORCE PIVOT

[75] Inventors: Jere L. McKee, Scott Township, Lawrence County; John P. Majcher, Chippewa Township, Beaver County; William E. Smith, New Brighton; Donald E. Schlosser, Beaver Falls, all of Pa.

[73] Assignee: Westinghouse Electric Corp., Pittsburgh, Pa.

[21] Appl. No.: 741,406

[22] Filed: Jun. 5, 1985

[51] Int. Cl.[4] ..... H01H 3/46

[52] U.S. Cl. ..... 200/153 G

[58] Field of Search ..... 200/153 G; 335/15, 192, 335/194

[56] References Cited

U.S. PATENT DOCUMENTS

| | | | |
|---|---|---|---|
| 3,600,539 | 8/1971 | Walker et al. | 200/153 G |
| 4,472,701 | 9/1984 | Bellows et al. | 200/153 G |
| 4,480,242 | 10/1984 | Castonguay et al. | 335/194 |
| 4,539,538 | 9/1985 | Flick et al. | 335/15 |

*Primary Examiner*—Henry K. Artis
*Assistant Examiner*—Renee S. Luebke
*Attorney, Agent, or Firm*—L. P. Johns

[57] ABSTRACT

A circuit breaker characterized by a movable contact carrying arm movable about a pivot and a helical torsion spring movable on the arm to and from the pivot for applying a varying force as the arm moves from closed to open positions.

5 Claims, 3 Drawing Figures

CIRCUIT BREAKER CONTACT ARM WITH VARIABLE FORCE PIVOT

BACKGROUND OF THE INVENTION

1. Field of the Invention

This invention relates to a circuit breaker and, more particularly, it pertains to a spring actuated movable contact arm.

2. Description of the Prior Art

A primary function of circuit interrupters is to provide electrical system protection and coordination whenever abnormalities occur on any part of the system. Operating voltage, continuous current, frequency, short circuit interrupting capabilities, and time current coordination requirements are some of the factors that must be considered when designing a circuit interrupter. Increasing demands are being placed upon the electrical industry for interrupters with improved performance.

SUMMARY OF THE INVENTION

In accordance with this invention a circuit breaker is provided which comprises an electrically insulated housing including line and load terminals; a circuit breaker structure within the housing and including separable first and second contacts in a circuit between the line and load terminals; a frame within the housing and including a contact arm stop; a contact arm for supporting the movable contact and pivotally mounted for movement between the open and closed positions; a circuit breaker operating mechanism releasable to effect opening and closing of the contacts and including a pivotally movable bracket mounted on one pivot; the contact arm being pivotally mounted on another pivot on the bracket; spring means for applying a closed-contact pressure on the arm at a distance from the other pivot which pressure is a product of a predetermined spring force and of said distance, the pressure being less than a repulsion force generated between the contacts due to a short circuit of a predetermined rating to effect opening of the contacts to an intermediate position; the spring means being movable upon opening of the arm to a location on the arm nearer the other pivot to produce a resulting pressure insufficient to reclose the arm; the spring means including a helical torsion spring having an end portion engaging the contact arm which end portion moves toward the other pivot to reduce said distance during rotation of the arm to effect reduction of pressure on the arm in the intermediate position; and the mechanism including manual means for rotating the bracket about the one pivot to move the contact arm from the intermediate position to the contact arm stop to cause the contact arm to rotate to a reset position for subsequent closing of the contacts.

The advantages of the device of this invention are reduction in short circuit let-through current and thermal let-through current values.

DESCRIPTION OF THE PREFERRED EMBODIMENT

Figure 1:
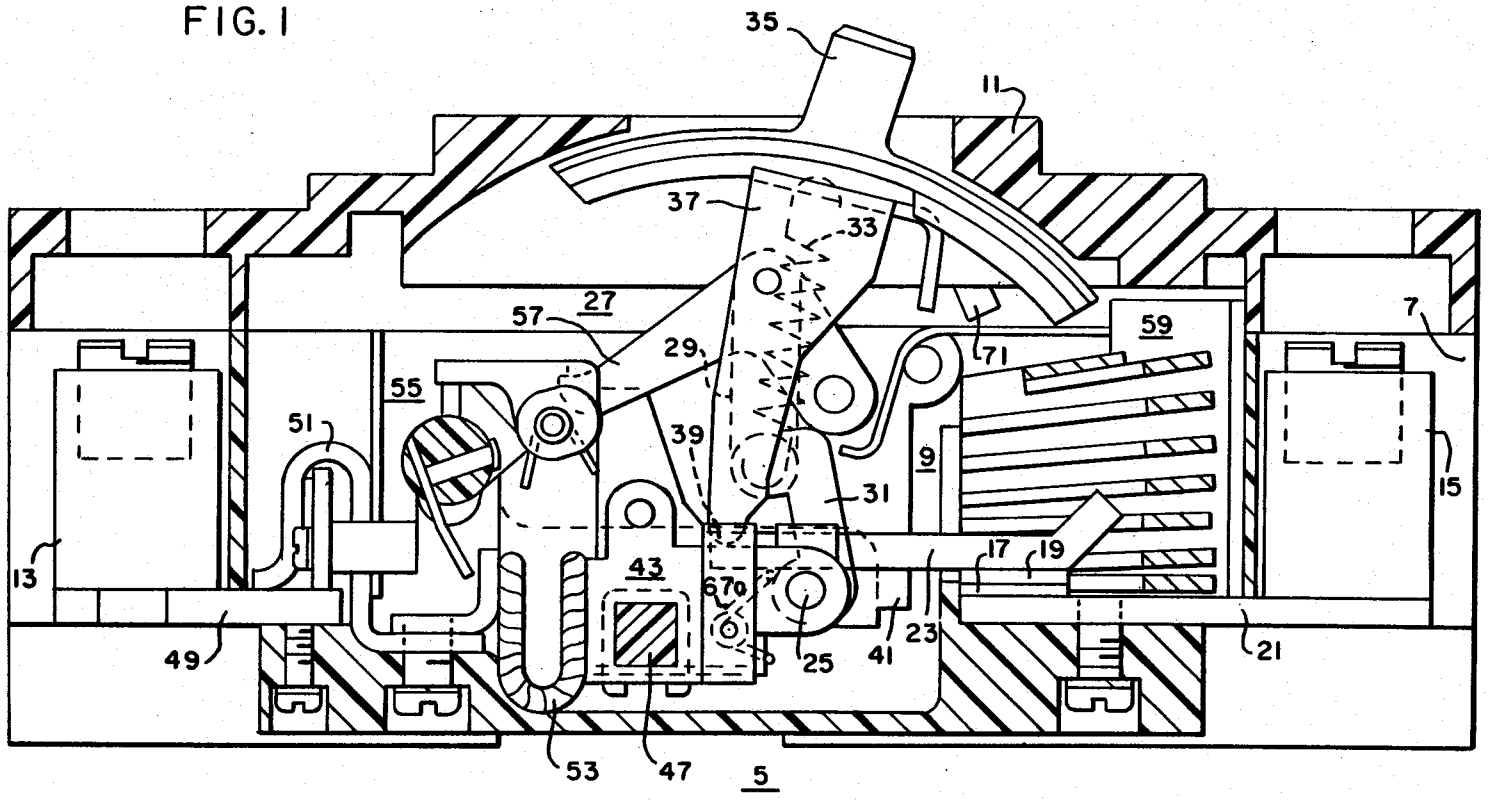
FIG. 1 is a vertical sectional view through a circuit breaker showing the feature of this invention.

In FIG. 1 a circuit breaker is generally indicated at 5 and it comprises a housing base 7 containing, among other things, a circuit breaker structure 9. The housing 7 includes a detachable cover 11, both of which are comprised of an electrically insulating material such as an epoxy. A line terminal 13 is disposed at one end of the housing and a load terminal 15 is disposed at the other end.

The circuit breaker structure 9 includes a stationary contact 17 and a movable contact 19. The stationary contact 17 is fixedly mounted on a conductor 21 which extends between the stationary contact and the load terminal 15. The movable contact 19 is fixedly mounted on a lever or contact carrying arm 23 which is pivotally mounted at pivot 25.

The circuit breaker structure 9 also comprises an operating mechanism 27 which actuates the contact carrying arm 23 between open and closed positions. The mechanism is typical of a toggle structure, such as that disclosed in U.S. Pat. Nos. 3,600,539 and 4,114,005. Briefly, the mechanism comprises a toggle including upper and lower toggle links 29, 31 and a closing spring assembly 33. The spring assembly 33 is charged with stored energy by moving a handle 35 manually to the on position (FIG. 1), whereby the contacts 17, 19 are closed. The handle is mounted on a inverted U-shaped switch arm 37 which is pivoted at 39 on spaced pairs of frames, one of which frames 41 is shown.

The operating mechanism also comprises a bracket 43 which is pivotally mounted at a cross bar 47. The bracket 43 carries the crossbar 47 by which adjacent phases (not shown) are connected to the operating mechanism 27. The pivot 25 is likewise carried by the bracket 43.

A circuit through the circuit breaker 5 extends from the line terminal 13 through interconnected conductors 49, 51, a shunt 53, the bracket 43, the arm 23, the contacts 19, 17, and the conductor 21 to the load terminal 15. When overload currents occur at predetermined ratings, an actuating mechanism generally indicated at 55 functions to release a cradle or release arm 57 to automatically open the contacts 17, 19 (as shown in FIG. 3).

Figure 3:
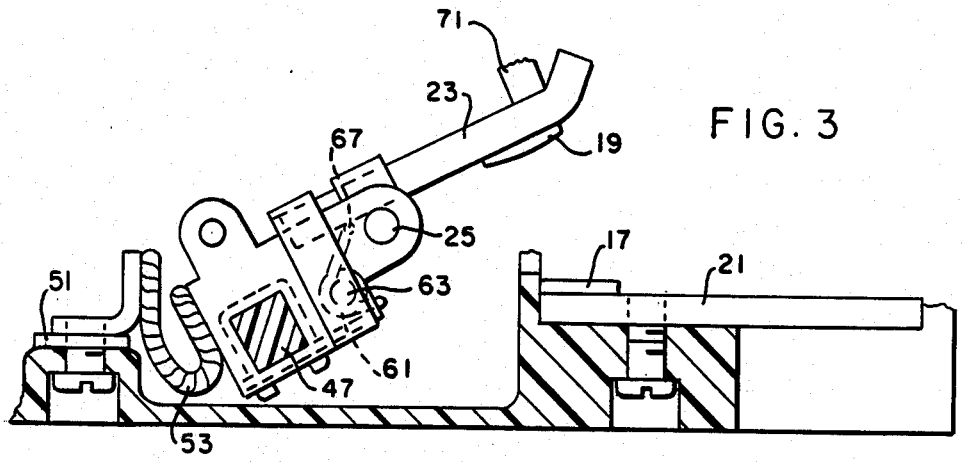
FIG. 3 is a fragmentary sectional view showing the contact arm in the tripped or open position.
Figure 2:
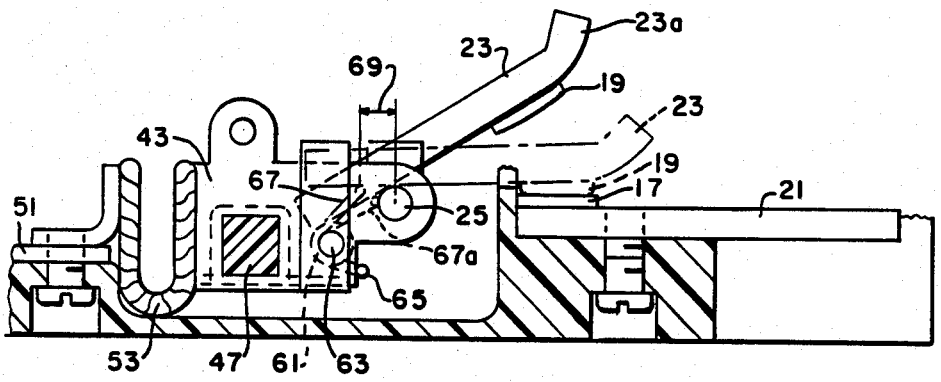
FIG. 2 is a fragmentary sectional view showing the contact arm in the closed and blown open positions.

An arc chute 59 of conventional construction is provided around the path of movement of the arm 23 as it moves between closed and open positions of FIGS. 2, 3.

In accordance with this invention, the arm 23 (FIG. 2) is mounted on the pivot 25 for movement independently of the bracket 43. As shown in FIG. 2, spring means, such as a helical torsion spring 61, is mounted on a pin 63 on the bracket 43. The spring includes opposite end portions 65, 67, the former of which engages the bracket 43 and the latter of which engages the undersurface of the arm 23 on the side of the pivot 25 opposite the contact 19. In the closed (broken line) position of the arm 23, the end portion 67 engages the surface of the arm 23 at a distance indicated by an arrow 69 to the left of the pivot 25. The pressure applied by the end portion 67 generally equals to the force of the spring multiplied by the distance 69.

Where, however, a short circuit of predetermined level occurs, the revulsion force at the contacts exceeds the pressure applied by the spring end portion 67 and the contact arm 23 is blown open to an intermediate position **23*a* (FIG. 2). As the arm moves to that position, the spring end portion 67 slides over the undersurface of the arm to position 67***a* closer to the pivot 25, whereby the distance between the end portion and the pivot is less than that indicated by the arrow 69. Indeed, it approaches zero, so that the arm remains in the intermediate position 23*a*. In order to reclose the contacts, the handle 35 is rotated counterclockwise (FIG. 1) to cause the toggle springs 33 to move overcenter, thereby rotating the bracket 43 from the position of FIG. 2 to that of FIG. 3 about the crossbar 47.

As that rotation occurs, the arm 23 is raised until it contacts an arm stop 71 located within the housing 7. As rotation continues, the arm 23, rotating about the pivot 25, returns to the original position on the bracket and the end portion 67 of the spring slides along the undersurface of the arm to the position shown in FIG. 3, thereby reassuming the distance from the pivot 25 indicated by the arrow 69 (FIG. 2). Thereafter, the handle 35 is moved to the on position (FIG. 1) and the contact 19 is brought into closed-contact position with the contact 17.

In conclusion, the device of this invention incorporates a torsion spring in conjunction with a variable lever arm which allows a circuit breaker contact arm to be blown open with a decreasing force against the contact gap distance. In this manner, forces on the breaker's mechanism, including the housing, the cover and related components, result in more design margin as compared with standard construction and allow a reduction in premium molding materials as required for high let-through current levels. Finally, these features occur without the use of slot motors or reverse loops, but can be used with slot motors or reverse loops.

What is claimed is:

1. A circuit breaker comprising:

(a) an insulating housing;

(b) a stationary contact within the housing;

(c) a movable contact within the housing and operable between open and closed contact positions with respect to the stationary contact;

(d) a contact arm stop within the housing;

(e) a contact arm for supporting the movable contact and pivotally mounted for movement between said positions;

(f) a circuit breaker operating mechanism to effect opening and closing of the contacts and including a pivotally movable bracket mounted at a first pivot;

(g) the contact arm being pivotally mounted on a second pivot to the bracket at a location between said first pivot and the movable contact;

(h) spring means mounted between the pivots for applying a closed-contact pressure on the arm at a distance from the second pivot which pressure is a product of a predetermined spring force and of said distance, the pressure being less than a repulsion force generated between the contacts due to a short circuit of a predetermined rating to effect opening of the contacts;

(i) the spring means being movable upon opening of the arm to a location on the arm nearer the second pivot to produce a resulting pressure insufficient to reclose the arm; and (j) the mechanism including manual means for rotating the bracket about the first pivot to move the contact arm to the contact arm stop to cause the contact arm to rotate to a reset position for subsequent closing of the contacts.

2. The circuit breaker of claim 1 in which the spring means comprises a torsion spring having an end portion engaging the contact arm.

3. The circuit breaker of claim 2 in which the end portion moves toward the second pivot to reduce said distance during rotation of the arm to the closed position.

4. The circuit breaker of claim 3 in which the spring is a helical torsion spring mounted on the bracket on the side of said second pivot opposite the movable contact.

5. The circuit breaker of claim 4 in which the end portion engages the contact arm at a location between the pivots.

* * * * *